US005786792A

United States Patent [19]

Bellus et al.

[11] Patent Number: 5,786,792

[45] Date of Patent: Jul. 28, 1998

[54] ANTENNA ARRAY PANEL STRUCTURE

[75] Inventors: Peter A. Bellus, Eden Prairie, Minn.; Robert J. Miklosko, Cary, N.C.; Thomas P. Fontana, White Bear Lake, Minn.

[73] Assignee: Northrop Grumman Corporation, Los Angeles, Calif.

[21] Appl. No.: 573,611

[22] Filed: Dec. 15, 1995

Related U.S. Application Data

[63] Continuation of Ser. No. 259,097, Jun. 13, 1994, abandoned.

[51] Int. Cl.[6] ..... H01Q 13/10

[52] U.S. Cl. ..... 343/770; 343/767; 343/872

[58] Field of Search ..... 343/770, 778, 343/789, 795, 872, 767, 873

[56] References Cited

U.S. PATENT DOCUMENTS

| | | | |
|---|---|---|---|
| 3,453,620 | 7/1969 | Fleming et al. | 343/872 |
| 3,836,976 | 9/1974 | Monser et al. | 343/795 |
| 4,001,834 | 1/1977 | Smith | 343/795 X |
| 4,500,887 | 2/1985 | Nester | 343/795 X |
| 4,686,536 | 8/1987 | Allcock | 343/795 X |
| 5,061,938 | 10/1991 | Zahn et al. | 343/700 MS |
| 5,185,611 | 2/1993 | Bitter | 343/770 X |
| 5,268,701 | 12/1993 | Smith | 343/770 X |
| 5,309,165 | 5/1994 | Segal et al. | 343/770 |

FOREIGN PATENT DOCUMENTS

| | | | |
|---|---|---|---|
| 0100387 | 5/1988 | Japan | 343/873 |

*Primary Examiner*—Donald T. Hajec
*Assistant Examiner*—Tho Phan
*Attorney, Agent, or Firm*—Walter G. Sutcliff

[57] ABSTRACT

A tapered notch antenna structural panel array that can serve both as a structural member and an antenna is made from an injection molded monolithic three dimensional grid of thermoplastic material. The notch and feed line are in the form of microstrip or stripline circuitry formed to the sidewalls of adjacent cells. Dielectric sheets of material are bonded to the upper and lower edges of the grid. Interconnect circuitry on the antenna ground plane is supported by the sheet bonded to the lower edge and connected to the antenna circuitry of the sidewalls.

4 Claims, 7 Drawing Sheets

FIG. 1
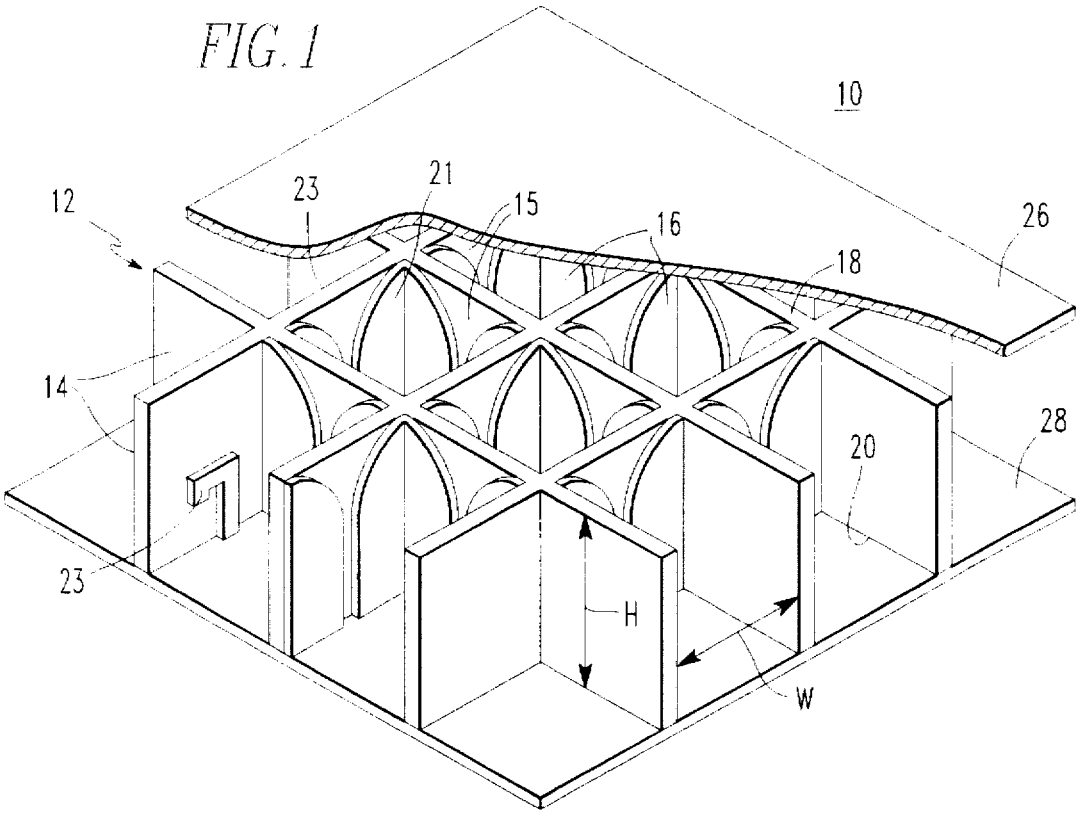
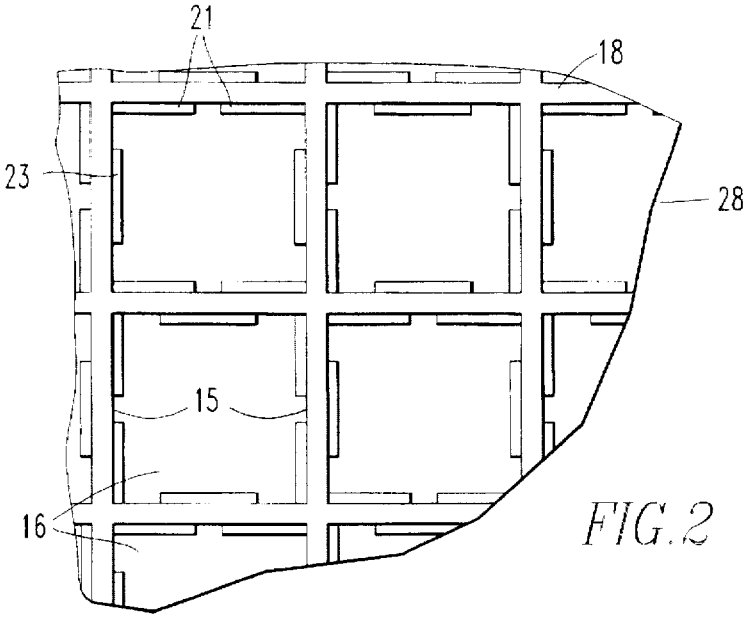
FIG. 2

FIG. 3
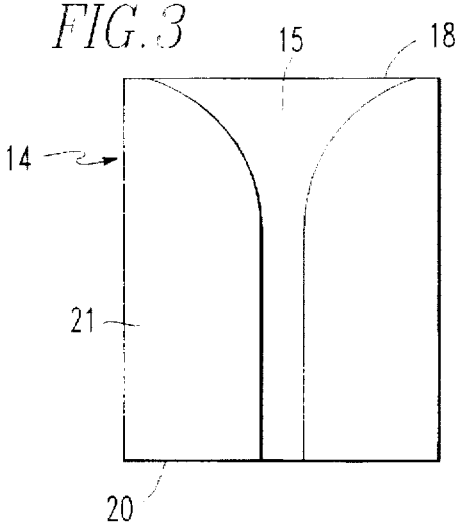
FIG. 4
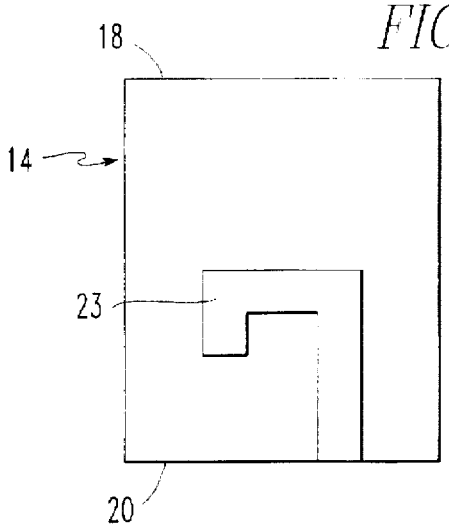
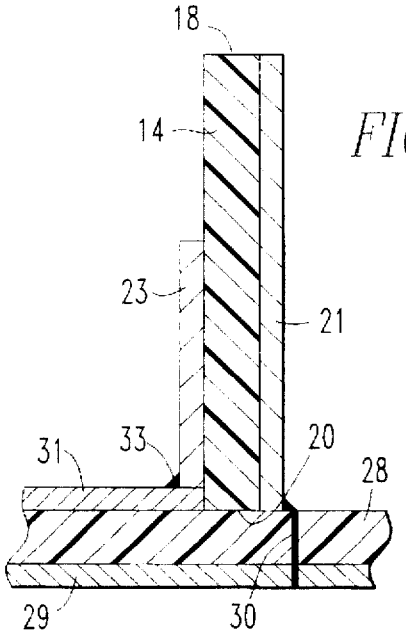
FIG. 5
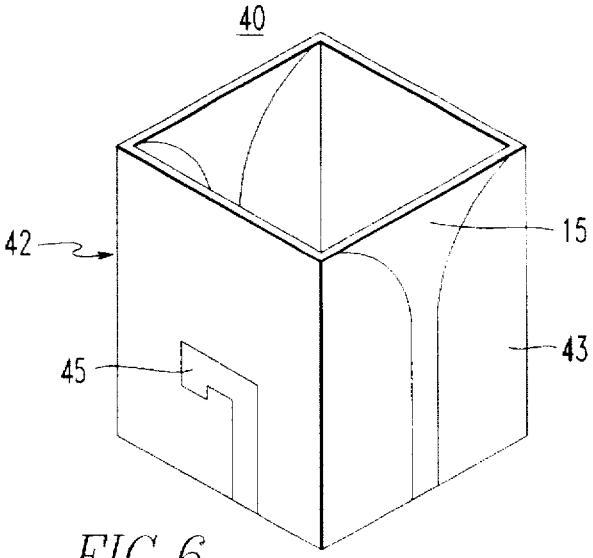
FIG. 6

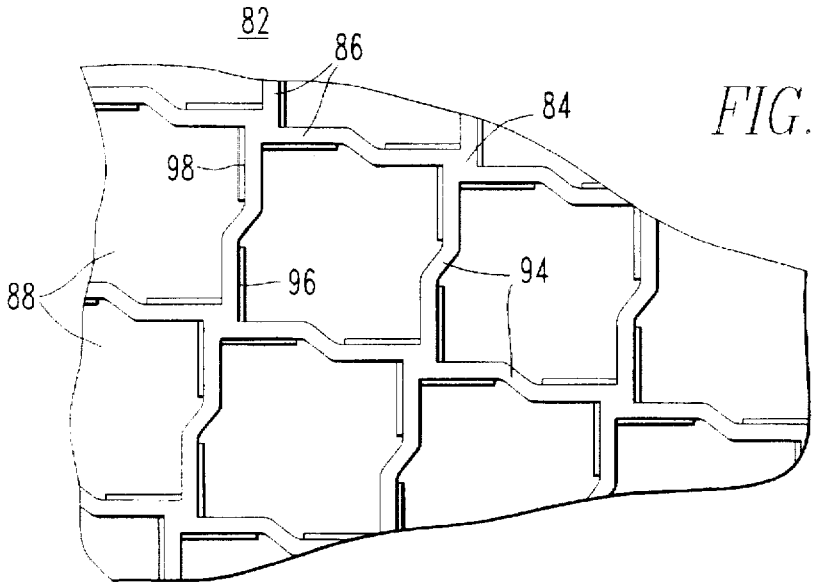
FIG. 11
FIG. 11B
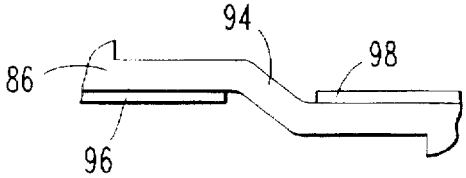
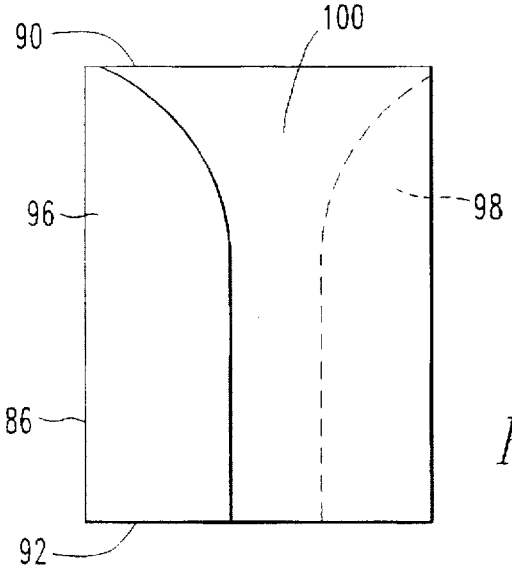
FIG. 11A

ANTENNA ARRAY PANEL STRUCTURE

This application is a continuation of application Ser. No. 08/259,097 filed Jun. 13, 1994, now abandoned.

BACKGROUND OF THE INVENTION

1. Field of the Invention

The present invention relates to antenna arrays; and more particularly, to a notch antenna array.

2. Description of Related Art

A preferred type of active antenna array is known as a notch radiator array, which is a microwave antenna that radiates and collects the RF energy through a network of notches or slots. A tapered notch antenna exhibits wide beam width characteristics, advanced beam-forming capability, and a low radar cross-section. Structurally, a tapered notch antenna array typically consists of intersecting strips of a dielectric material that uses stripline antenna circuitry. The stripline circuitry typically employs three metal layers in a sandwich or laminated configuration, with the antenna circuitry being applied to the dielectric strips in a manner similar to that in making a printed circuit board. Then, the individual strips are assembled in an egg crate or honeycomb type of structure.

A notch antenna array may be configured as a separate antenna, which for airborne applications is usually situated in the nose of the plane enclosed by a radome. However, the notch antenna array is also suitable for use as a conformal antenna. For such applications it is necessary to mount the antenna in the fuselage or wing of the aircraft so as not to interfere with the aircraft assemblage or weaken the structure. In certain conformal applications, the mounting of this antenna necessitates a thicker structural wall to accommodate the required antenna mass; or at the very least adds appreciably to the weight of the carrier.

In light of the foregoing, there is a need for a notched antenna array that is relatively simple in construction, economical to manufacture; does not appreciably add to the weight or internal occupancy of the aircraft; or complicate assembly or construction of the airframe.

SUMMARY OF THE INVENTION

Accordingly, the present invention is directed to a notched active antenna array that substantially obviates one or more of the problems due to limitations and disadvantages of the prior art.

The features and advantages of the invention will be set forth in the description which follows, and in part will be apparent from the description, or may be learned by practice of the invention. The objectives and other advantages of the invention will be realized and attained by the apparatus and method particularly pointed out in the written description and claims hereof as well as the appended drawings.

To achieve these and other advantages, and in accordance with the purpose of the invention, as embodied and broadly described, the invention is an antenna array panel structure that has a monolithic three dimensional grid of dielectric material and sidewalls defining a plurality of adjacent polygonal cells. The sidewalls have an upper and lower edge. A circuit is formed on opposite surfaces of each of the sidewalls between the upper and lower edges. A first sheet of dielectric material is bonded to the upper edge of each of the sidewalls that serves as a structural outer skin and antenna radome. A second sheet of dielectric material is bonded to the lower edge of each of the sidewalls serving as both a structural inner skin and as a member supporting interconnect circuitry for the antenna circuitry.

In another aspect, the invention is a method of manufacturing an article to serve both as a tapered notch antenna array and a structural panel member that includes forming by injection molding a three dimensional monolithic grid of dielectric material having sidewalls defining a plurality of adjacent polygonal cells with upper and lower edges; plating the three dimensional grid with metal; coating the plated grid with photoresist; imaging the photoresist coating on the plated sidewalls to form antenna circuitry between the upper and lower edges; developing the imaged photoresist; etching the developed photoresist, and stripping the photoresist from the grid to form the antenna circuitry.

In still another aspect, the invention is a method of manufacturing an article to serve both as a tapered notch antenna array and a structural panel member that includes forming by injection molding a three dimensional monolithic grid of dielectric material having sidewalls defining a plurality of adjacent polygonal cells with upper and lower edges; providing antenna circuitry on a thin sheet of a flexible dielectric material, bending the material into a polygon to fit against the walls of the mold, injecting the molten dielectric into the mold to form the three dimensional grid with the flexible circuitry attached to the walls of the polygonal cells.

In other respects, feedline circuitry can be molded within the grid approximately half way between opposite surfaces or be offset to be closer to one sidewall surface than the other.

It is to be understood that both the foregoing general description and the following detailed description are exemplary and explanatory and are intended to provide further explanation of the invention as claimed.

The accompanying drawings are included to provide a further understanding of the invention and are incorporated in and constitute a part of this specification, illustrate one embodiment of the invention, and together with the description serve to explain the principles of the invention.

BRIEF DESCRIPTION OF THE DRAWINGS

FIG. 1 is a fragmentary three dimensional view, with portions cut away, of one embodiment of the antenna panel structure of the present invention;

FIG. 2 is a fragmentary top view of the antenna panel of FIG. 1;

FIGS. 3 and 4 are elevational views of opposite sides of a sidewall of the antenna panel of FIG. 1;

FIG. 5 is a sectional view in elevation taken along line 5—5 of FIG. 2;

FIG. 6 is a three dimensional view of a phototool used in developing photoresist on the sidewalls of the individual cells in manufacturing the device of FIG. 1;

FIG. 11 is a fragmentary top view of a fifth embodiment of the antenna panel structure of the present invention; and FIGS. 11A and 11B are an elevational view and a top view respectively of a sidewall of the embodiment of FIG. 11.

DESCRIPTION OF PREFERRED EMBODIMENTS

Figure 7A:
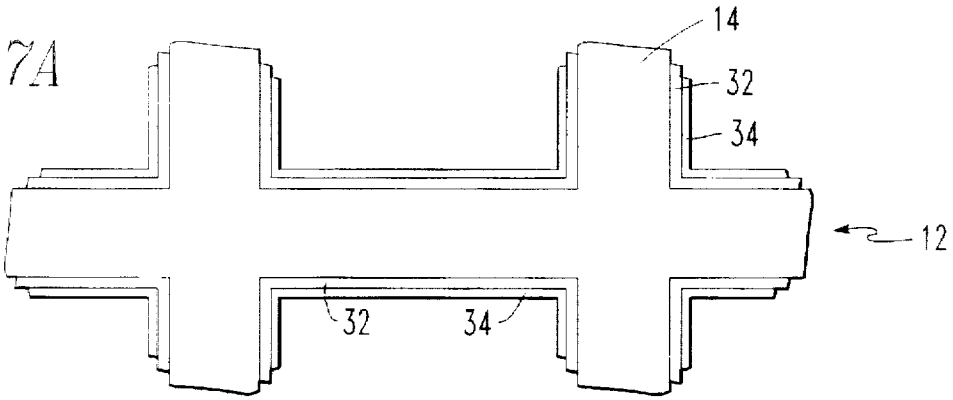
FIGS. 7A, 7B and 7C are fragmentary top views of a portion of the grid illustrating the steps in the manufacture of the array of FIG. 1 using microstrip circuitry.

Reference will now be made in detail to the present preferred embodiments of the invention, examples of which are illustrated in the accompanying drawings.

One exemplary embodiment of the antenna array panel structure of the present invention is shown in FIG. 1, and is designated generally by the reference numeral 10. In accordance with the invention, the antenna array panel structure comprises a monolithic three dimensional grid of dielectric material having sidewalls defining a plurality of adjacent cells. As herein embodied and referring to FIGS. 1 and 2, a grid 12 is made of a fiber reinforced thermoplastic dielectric material that is formed by injection molding. The thermoplastic material may be of any suitable type, such as polyethylene or polystyrene, for example, that has a dielectric constant in the range of approximately two to ten. The grid 12 has sidewalls 14 that define a plurality of cells 16. Although the cells 16 may be a polygon having more or less than four sides, the cells 16 are preferably four sided rectangles. The grid 12 has upper edges 18 and lower edges 20, which define a height dimension H of the grid 12.

In accordance with the invention, a circuit is formed on opposite surfaces of each of the sidewalls between the upper and lower edges of the grid. As herein embodied and referring to FIGS. 2 through 4, antenna circuitry 21 of plated copper having a configuration defining a notch radiator 15 is formed on one surface of the sidewall 14 and antenna circuitry 23 corresponding to the feed line of the radiator is disposed on the sidewall surface opposite the notch, which is bounded by circuitry 21. The portion of the circuitry 21 for forming the notch radiator 15 defines a notch extending between the lower and upper edges of the sidewalls and flares out into a horn shaped configuration near the upper edge. The notches are preferably formed centrally of each sidewall 14. The feed circuitry 23 on the opposite surface of the sidewall is in the form of an inverted J, as shown in FIG. 4.

The sidewalls 14 of each cell have a width dimension W which defines the distance between the individual radiators 21. In the illustrated embodiments, the cells 16 are square, thus the individual notches which flare in a direction parallel to one another are equally spaced from each other and from the notches that flare perpendicular thereto. The area of the cells, the size and thickness of the microstrip tapered notch, and the thickness of the sidewalls depend on the desired characteristics of the antenna system, the dielectric constant of the grid material and the structural requirements of the panel.

In accordance with the invention, the antenna structural panel array includes a first sheet of dielectric material bonded to the upper edge of the grid which serves a structural outer skin and antenna radome. As herein embodied, and again referring to FIG. 1, a sheet 26 of dielectric material may be bonded to the upper edges 18 of the grid 12 by a suitable construction adhesive, for example.

In accordance with the invention, the antenna structural panel array also includes a second sheet of a dielectric material, which may be similar to the first sheet, bonded to the lower edges of the grid by a suitable adhesive. As herein embodied, a sheet 28 is bonded to the lower edges 20 of the grid, similar to sheet 26. Thus, the grid 12, when bonded between dielectric sheets 26 and 28 forms the panel structure 10, with the grid 12 serving as the core of the structural panel as well as a tapered notch antenna array.

In accordance with the invention, the plate 28 supports interconnect circuitry for the individual radiators. As shown in FIGS. 2 and 5, the sheet 28 supports interconnect circuitry which includes a metal backing 29 which serves as the ground plane of the antenna, and, which is connected through a plated through hole filled with solder 30 to the circuitry 21 defining each notch. The feedlines 23 of each notch are connected to metallic lines 31 by soldering, for example at 33.

Several processes of making the tapered notch structural panel antenna array of the present invention will now be described. Initially, the grid 12 is formed by injection molding of the thermoplastic material, and then cutting the grid to the proper height dimension H as shown in FIG. 1.

Next, and referring to FIG. 7A, the entire grid 12 is plated preferably first with a thin copper film 32 by the electroless deposition method, for example. In order to obtain the proper thickness of metal on the sidewalls 14, the entire grid 12 is then electroplated to deposit an additional layer of copper 34. The total thickness of the metal plating is preferably about 1 mil (½ oz. per sq. foot) for a fifty ohm antenna, for example. Other antenna parameters may require a different metallic thickness.

Figure 7B:
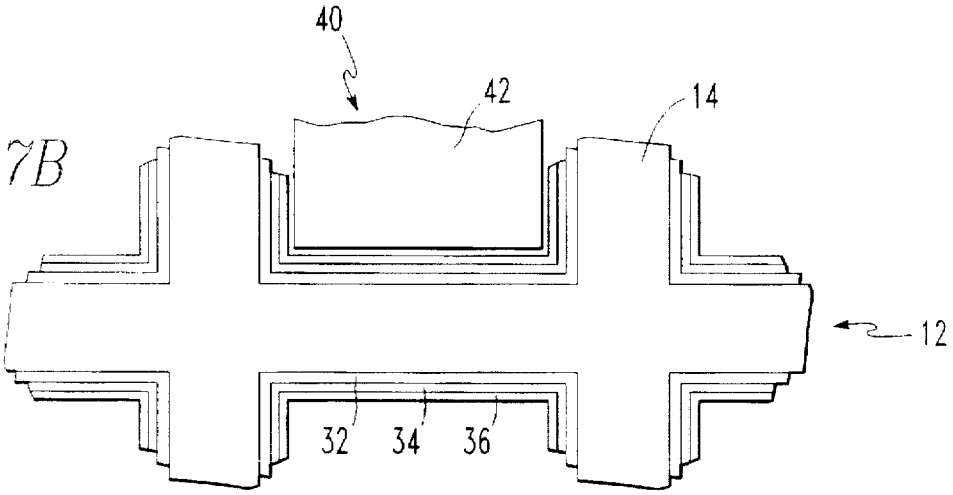

As shown in FIG. 7B, after the proper metallic thickness has been obtained, the entire grid is coated next with a photoresist 36. The photoresist 36 is then imaged by the well known direct laser method, or by inserting a phototool, such as 40 (see FIG. 6) in each of the cells 16 of the coated grid. As shown in FIG. 6, the phototool 40 is in the form of a transparent cubical frame 42 having a width and height dimension such that the frame will slidably fit in and cover opposing surfaces of each of the sidewall 14 of the cell 16. The tool 40 includes a lamp (not shown) positioned in the interior of the frame 42 to provide the imaging illumination. One wall of the frame 42 has a printed circuit pattern 41 that corresponds to the shape of the circuitry 21 which defines the notch and another wall has a printed pattern 43 that corresponds to the feedline circuitry 23 for developing the photoresist 36 in the corresponding pattern.

Figure 7C:
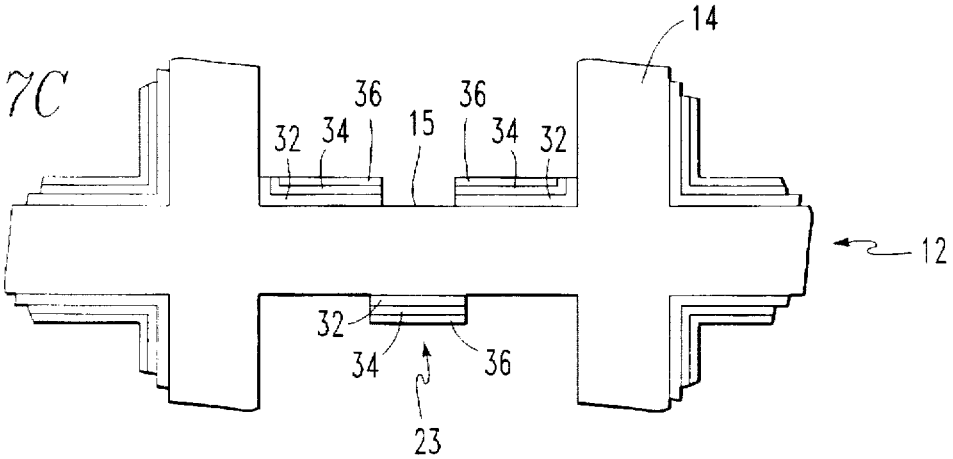

Referring to FIG. 7C, after the photoresist has been imaged and developed in a well known manner, the entire grid 12 is etched, which removes, from one surface of the sidewall 14, the portion of the copper layer in the form of a flared horn to form the notch 15, as best seen in FIG. 3, and removes from the opposite side the entire copper layer, with the exception of the circuitry 23 in the form of a J, as best seen in FIG. 4. The remaining photoresist 36 is then stripped from the remaining copper layer 34, leaving a completed core as best seen in FIG. 2.

Preferably, prior to bonding sheet 28 to the completed core structure, a layer of copper 29 is plated to one surface or ground plane of the sheet 28 and the feedline connecting lines 31 are printed on that surface of sheet 28 which is to be in contact with the lower edge 20 of the sidewalls. The through holes are then formed and plated. After bonding the sheet 28 to the edge 20 in any well known suitable manner, the feedlines 23 are interconnected, such as by soldering at 33, to the printed lines 31; and the circuitry 21 defining each of the notches 15, is soldered by solder 30 to the ground plane 29. As a final step in manufacturing the panel structure 10, the upper sheet 26 is bonded to the edge 18.

Figure 8:
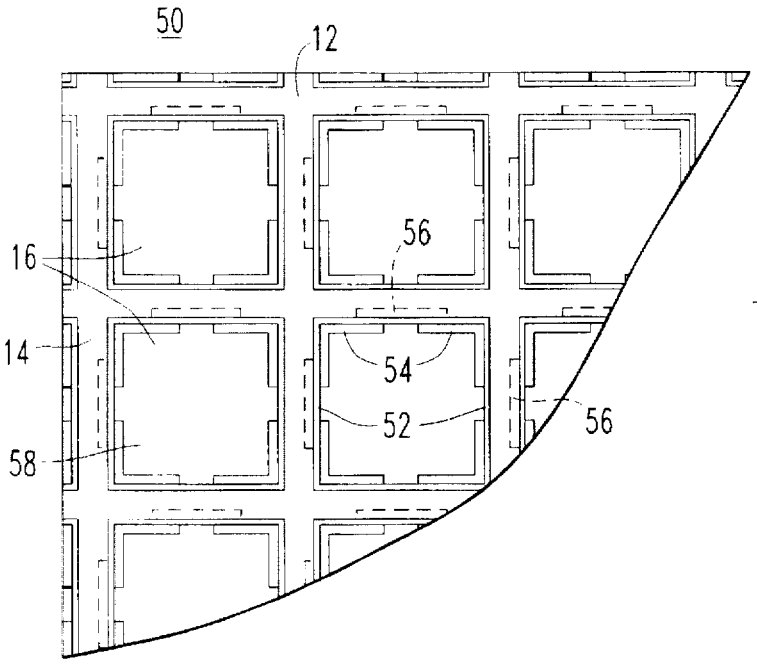
FIG. 8 is a fragmentary top view of an antenna panel structure in accordance with a second embodiment of the invention.
Figure 8B:
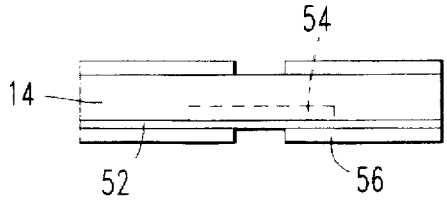
FIGS. 8A and 8B are an elevational view and a top view respectively of a sidewall of the embodiment of FIG. 8.
Figure 8A:
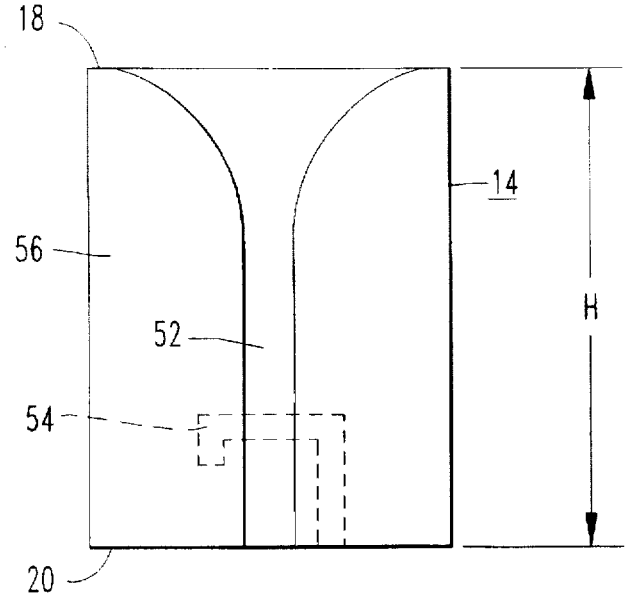

Referring to FIGS. 8, 8A and 8B an antenna panel structure with a stripline circuitry according to a second embodiment of the invention is referred to as reference numeral 50 which includes a grid 12 similar to FIG. 2, which has sidewalls 14 forming rectangular cells 11 and upper and lower edges 18 and 20, respectively. A thin dielectric element 52, such as a polymer film material, 5 to 10 mils in thickness, forms the circuit substrate. A flexible copper circuit is formed on both sides of the film 52. On one surface of the film 52 is a feed circuit 54 in the form of a J and on the opposite side is circuitry 56 which defines the antenna notch. The film 52 is bent into a square box and inserted into the cavities of the mold that is used to mold the structural array. The feed circuitry 54, which is two J configured feed lines, are on the outside of the box to be located centrally on two adjacent sidewalls 14 of each cell 16. The notch circuitry 56 is on the inner surface of the box. Each flared portion of circuitry 56 forms one side of two notches in adjacent sidewalls 14 of each cell 16. Resin 58 is injected into the mold to fill each cavity and capture the feed circuit at the walls of the respective cavities. The flexible circuits need not be used for all of the cells so the antenna portion of the supporting structure can be limited to selected portions of panel structure. With the embodiment of FIG. 8, the feedline circuitry 54 is unequally spaced relative to the surface or ground plane of walls 14 of the structural gird 12. The flexible circuit is formed from the polymer film which has copper foil adhering to both sides of the film. The film may be polyetherimide, polysulfone or polycarbonate, for example. The copper foil could be electrodeposited, or comprised of rolled annealed foils. The copper may be bonded to the film with adhesives, or bonded directly to the film when in a molten state. In the case of electrodeposition, the copper may be electroplated to the film after application of an electroless copper layer, or vacuum metallized layer. The copper foil would then be coated with a photoresist, imaged through a mask, developed, and etched.

Figure 9:
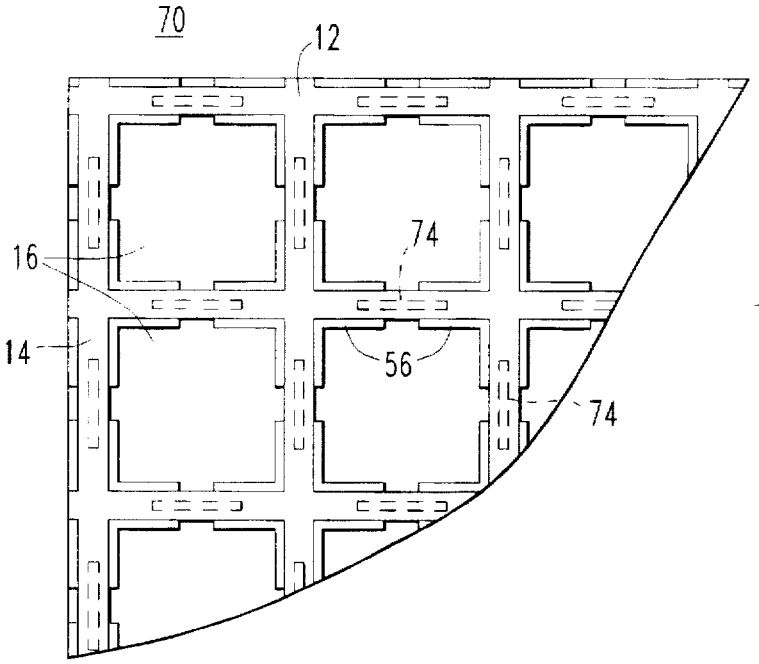
FIG. 9 is a fragmentary top view of a third embodiment of the antenna panel structure of the present invention.
Figure 9B:
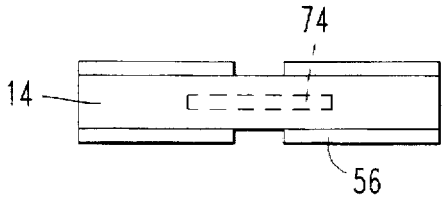
FIGS. 9A and 9B are an elevational view and a top view respectively of a sidewall of the embodiment of FIG. 9.
Figure 9A:
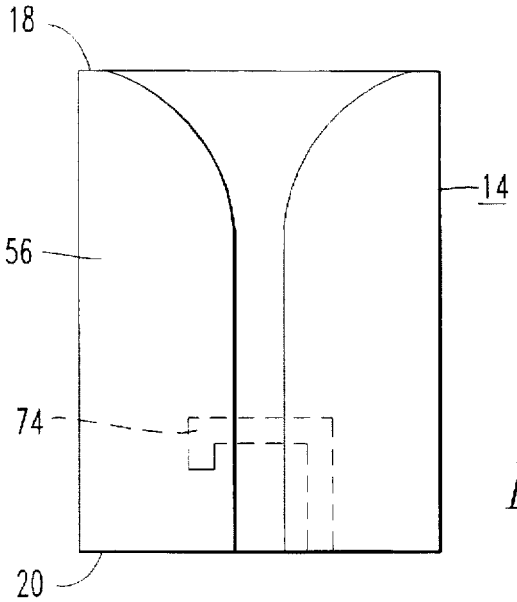

Referring to FIGS. 9, 9A, and 9B an antenna panel structure 70 according to a third embodiment of the invention illustrates a stripline circuitry with feedline circuitry 74 equally spaced from opposite surfaces of ground plane sidewalls 14, instead of being offset as in the second embodiment. The notch circuitry 56 can be formed as describe for either the first described or the second embodiment. However, a single side flex circuit would be used instead of a double sided flexible circuit as in the second embodiment. In the molding step, feed circuit 74 would be in the form of a wire feed and positioned in the mold prior to the pouring of the resin to capture the wire feed in the mold. The design of the mold and molding conditions, such as pressure and viscosity would need to be carefully selected so that the feedline circuit 74 would not be distorted.

Figure 10:
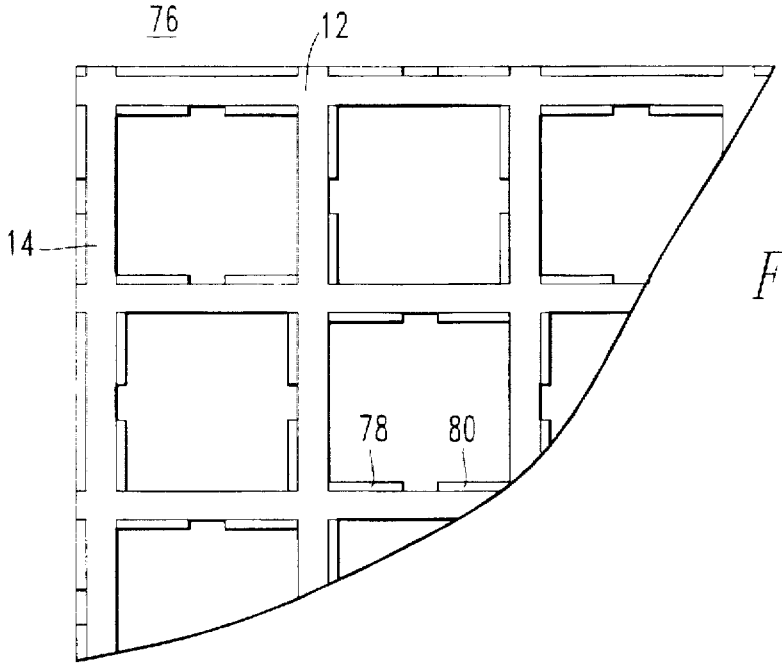
FIG. 10 is a fragmentary top view of a fourth embodiment of the antenna panel structure of the present invention.
Figure 10B:
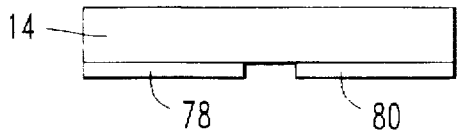
FIGS. 10A and 10B are an elevational view and a top view respectively of a sidewall of the embodiment of FIG. 10.
Figure 10A:
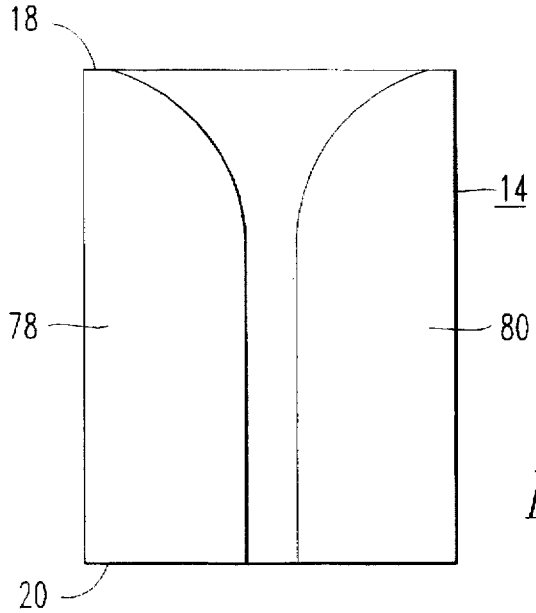

Referring to FIGS. 10, 10A and 10B, an antenna panel structure according to a fourth embodiment of the invention is referred to as 76. This embodiment is similar to the first, second, and third embodiments, except that it includes only notch circuitry 78 and 80. The notch is fed by connecting one line of the circuitry such as 78 to the interconnect circuitry to feed the notch. The antenna panel structure 76 may be limited in its application because conductors 78 and 80 are on the same surface of the wall 14 of the grid. This embodiment may be fabricated in the same as the first or second embodiment without the necessity of separate feed circuitry.

FIGS. 11, 11A and 11B illustrate an antenna panel structure according to a fifth embodiment of the invention, which is generally referred to as 82. The structure 82 has an injection molded three dimensional monolithic grid 84 similar to the grid 12. The grid 84 has sidewalls 86 that define a plurality of cells 88. The grid 84 has a top edge 90 and a bottom edge 92. The sidewalls 86 of each cell 88 are offset at 94 approximately midway between the corners of each cell. Each wall 86 is offset at 94 so that a first portion of the wall has a surface 96 facing one cell, that lies in the same plane as an opposite surface 98 of the same wall, which faces an adjacent cell 88. One half of the circuitry for each notch referred to at 100 faces inwardly in each cell; and the other half is on the opposite wall surface so that each wall 86 has a notch that is formed by flared circuitry on opposite surfaces of the wall that are in the same plane. The notch radiator defined by circuitry 100 on an opposite surface of the wall 86, in the same plane, is fed differentially across the two sides of the horn formed by circuits 100. Thus, fifth embodiment 82 may be fabricated by the method described in connection with the first and second embodiments, and is not subjected to a trapped mode, which may be the case in connection with the fourth embodiment. Sheets such as 26 and 28 shown in FIG. 1 are also fastened to the upper edge 18 and lower edge 20 of the core 12 to complete the structural panel of the second, third, and fourth embodiment. Similar panels are also attached to the upper and lower surfaces 90 and 92 of the fifth embodiment. The interconnect circuitry for each of the embodiments is similar to that described in connection with FIG. 5.

In summary, we have described several embodiments of an article of manufacture, and an efficient manner of making same, that satisfies the electrical requirements of a notch antenna array and the strength requirements of a structural panel.

It will be apparent to those skilled in the art that various modifications and variations can be made in the tapered notch panel antenna and method of the present invention without departing from the spirit or scope of the invention. Thus it is intended that the present invention cover the modifications and variations of this invention provided they come within the scope of the appended claims and their equivalents.

We claim:

1. An antenna array, comprising:

a monolithic three dimensional grid of dielectric material having sidewalls defining a plurality of adjacent polygonal cells, said sidewalls having an upper and lower edge;

an antenna circuit formed on at least one of the sidewalls of a plurality of the cells, between the upper and lower edge thereof, to form a plurality of notch radiating elements having a horn shaped configuration, said radiating elements being positioned near the center of said sidewalls, and wherein each of said sidewalls is offset intermediate their ends so that approximately one-half of the sidewall is offset from another half, and the antenna circuitry comprises a notch formed by circuitry on opposite surfaces of the wall offset from one another;

a first sheet of dielectric material bonded to the upper edge of the grid serving as a structural outer skin and antenna radome; and a second sheet bonded to the lower edge of each of the sidewalls serving as both a structural inner skin and as a member supporting interconnecting circuitry of the antenna.

2. The array of claim 1 wherein the antenna circuit is fed differentially across opposite sides of the notch.

3. The array of claim 1 wherein an antenna circuit is formed on all of said sidewalls and each antenna circuit is fed differentially across opposite sides of a respective notch.

4. The array of claim 1 wherein each of said cells includes four sidewalls.

* * * * *